United States Patent [19]

Matsuda et al.

[11] 4,229,235

[45] Oct. 21, 1980

[54] HEAT-TREATING METHOD FOR PIPES

[75] Inventors: Noriaki Matsuda, Mito; Kunio Enomoto, Ibaraki, both of Japan

[73] Assignee: Hitachi, Ltd., Japan

[21] Appl. No.: 845,063

[22] Filed: Oct. 25, 1977

[51] Int. Cl.[3] ..... C21D 9/08

[52] U.S. Cl. ..... 148/127; 148/39; 148/150; 148/153; 148/154; 148/155; 148/157

[58] Field of Search ..... 148/143, 145, 39, 150, 148/153, 154, 155, 157, 127; 75/128 R, 128 N

[56] References Cited

U.S. PATENT DOCUMENTS

| | | | |
|---|---|---|---|
| 2,150,901 | 3/1939 | Arness | 75/128 N |
| 3,567,529 | 3/1971 | Burtnett | 148/150 |
| 3,992,231 | 11/1976 | Timmons | 148/143 |

FOREIGN PATENT DOCUMENTS 49-76716 7/1974 Japan .

*Primary Examiner*—R. Dean
*Attorney, Agent, or Firm*—Craig & Antonelli

[57] ABSTRACT

Disclosed is a method of heat-treating a pipe in which cooling water is passed through the pipe while the pipe is heated from the outer side thereof, so as to create a temperature differential between the outer and the inner sides of the pipe, so that the inner side of the pipe may be tension-yielded or the outer side of the pipe may be compression-yielded, thereby to generate a compressive residual stress and a tensile residual stress at the inner and the outer sides of the pipe, respectively.

26 Claims, 11 Drawing Figures

HEAT-TREATING METHOD FOR PIPES

BACKGROUND OF THE INVENTION

The present invention relates to a method of heat-treating pipes and, more particularly, to a heat treating method for pipes capable of increasing the strength of the pipe against corrosion fatigue.

In modern nuclear plants, power stations and chemical plants, many straight, bent or other shaped pipes are connected, by welding or the like measures, so as to form continuous long pipe systems. However, especially in power stations, these pipes are used under strict conditions of high temperature and pressure, often causing the stress generated in the pipe to come up close to the yielding strength of the pipe material.

In general, these pipes are fabricated by plastic work and connected usually by welding. The residual tensile stresses caused by the plastic work and the welding are superimposed to a repetitive stress generated during the operation of the plant (e.g. repeated thermal stress), so as to cause a large compound stress. In addition, when a corrosive fluid is passed through the pipe system, it is necessary to take also the corrosion fatigue into consideration.

Hitherto, in order to diminish the residual stresses caused by the plastic work and the welding, various heat treating methods have been proposed and used in accordance with the kinds of materials of the pipes.

However, in these conventional heat treating method, tensile residual stress is left in the inner side of the pipe, due to the differential of cooling rate between the outer and the inner sides of the pipe during treating.

More specifically, in case of a pipe made of stainless steel, the heat treatment has been conducted in such a manner that the pipe is at first heated as a whole to a high temperature, and then dipped into a tank filled with cooling water. However, since the inner side of the pipe is not cooled until it is reached by the cooling water getting into the pipe through the end openings, the commencement of the cooling at the inside of the pipe is lagged behind that at the outer side of the pipe at which the cooling is started immediately after the dipping by the direct contact with the cooling water. In addition, the inner side of the pipe cannot contact sufficiently cold cooling water, while the temperature rise of the cooling water is not so high at the outer side of the pipe, so that the cooling rate is smaller at the inner side of the pipe than at the outer side, causing tensile residual stress in the inner side of the pipe. Furthermore, since there is a practical limit in the size of the pipe, only the essential parts of the pipe can be sufficiently cooled.

Thus, the conventional heat treatment cannot diminish the residual stress sufficiently well, so that the problem of rupture of pipe remains still unsolved, because of the poor strength against the corrosion fatigue, especially when a corrosive fluid is circulated though the pipe.

SUMMARY OF THE INVENTION

It is therefore an object of the invention to prevent rupture of pipes.

It is another object of the invention to improve the anti-corrosion-fatigue resistance or strength of pipes.

It is still another object of the invention to prevent cracking of pipes attributable to corrosion fatigue.

It is a further object of the invention to provide a heat treating method for pipes capable of treating whole part of pipe at one time.

To these ends, according to the invention, there is provided a method of heat treating a pipe characterized by comprising a step of heating a first side of a pipe which contacts a corrosive liquid, so as to cause a temperature differential between said first side and a second side of said pipe, thereby to cause a compressive yielding at said first side and a tensile yielding at said second side. Thus, according to the invention, a residual compressive stress is imparted to the second side of a pipe which contacts the corrosive liquid, so that the rupture of the pipe is conveniently avoided.

DESCRIPTION OF THE PREFERRED EMBODIMENT

Figure 1:
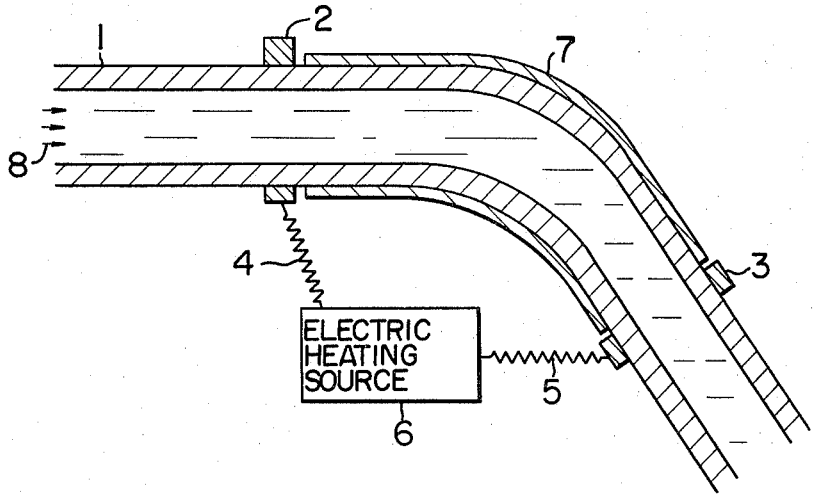
FIG. 1 is an illustration explanatory of a theory of a heat treating method for pipes, in accordance with the invention.

Referring at first to FIG. 1 illustrating the theory or principle of the invention, ring-shaped electrodes 2 and 3 are attached to a pipe 1. These electrodes 2, 3 are spaced from each other. The pipe 1 is surrounded at its portion between the electrodes 2, 3 by a heat-insulating material 7. The electrodes 2 and 3 are connected to a power source 6, through lead wires 3 and 4, respectively.

Figure 2:
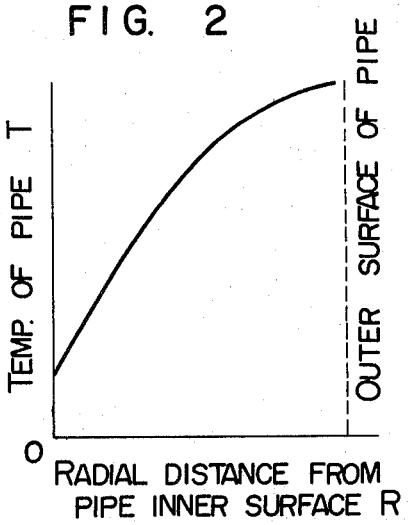
FIG. 2 shows a radial temperature distribution in a pipe treated by the heat treating method of FIG. 1.
Figure 3:
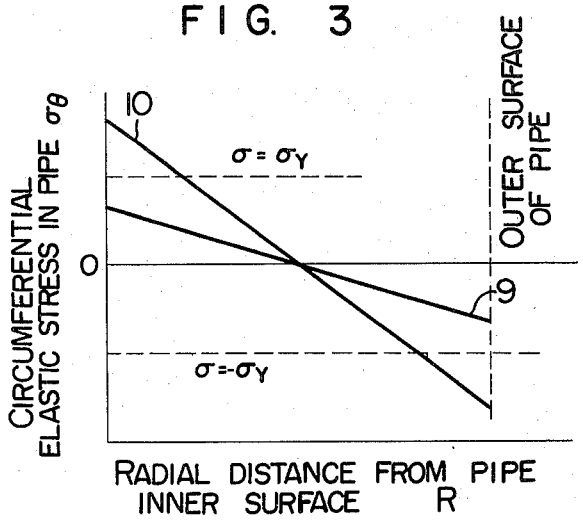
FIG. 3 shows a radial distribution of stress acting in tangential direction of the pipe generated in the pipe as a result of the temperature distribution as shown in FIG. 2.
Figure 4:
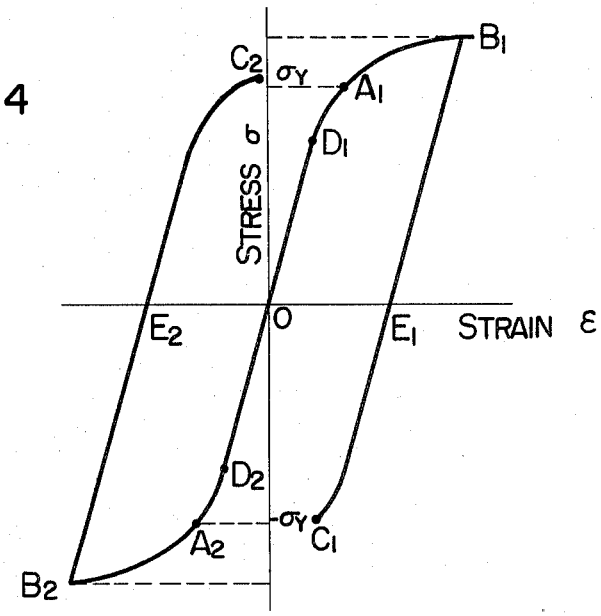
FIG. 4 is a hysteresis loop diagram on the inner and the outer sides of the pipe.

The pipe 1 is adapted to pass cooling water 8 therethrough. As a switch (not shown) for the power source 6 is turned on, an electric current is made to pass through a circuit constituted by power source 6, wire 4, electrode 2, pipe 1, electrode 3 and the wire 5. As the current passes through the pipe 1, the portion of the pipe 1 between two electrodes 2, 3 generates heat due to the resistance of the pipe material. Thus, provided that there is no supply of the cooling water 8, the pipe is heated uniformly in the radial direction. However, because of the provision of the cooling water, the generated heat is delivered to the cooling water from the inner side of the pipe, so that the pipe 1 exhibits a radial temperature distribution as shown in FIG. 2. A stress distribution as shown in FIG. 3 is resulted by the temperature distribution as shown in FIG. 2. Further, FIG. 4 shows a relationship between the stress and strain.

Provided that the temperature differential between the outer and the inner sides of the pipe is sufficiently small, the stresses generated in these sides do not go beyond the yielding point. Thus, strains remain of a magnitude represented by the lines $OD_2$ and $OD_1$ at the outer and inner sides of the pipe, and can return to 0 as the heating is stopped, during which the pipe exhibits a thickness wise stress distribution as shown by curve 9 of FIG. 3.

However, when the temperature differential between the outer and the inner pipe sides exceeds a certain value, the pipe 1 comes to exhibit a thickness wise elastic stress distribution as shown by curve 10, and the stresses at the inner and the outer sides of the pipe grow larger than tensile yielding stress $\sigma_r$ and the compressive yielding stress $\sigma_r$, respectively. These stresses are represented by $B_1$ and $B_2$ in FIG. 4.

As the heating is stopped at this state, the stress is gradually decreased along a curve $B_1E_1$, and falls to $C_1$ when the inner side temperature becomes uniform, at the inside of the pipe. Similarly, the stress is decreased finally to $C_2$, at the outer side of the pipe, following the curve $B_2E_2C_2$. Consequently, a tensile residual stress is left in the outer side of the pipe, while a compressive residual stress is generated in the inner side of the pipe.

Therefore, the yielding stresses are increased to $B_1C_1$, and $B_2C_2$, over that $\sigma_r(OA_1, OA_2)$ of the pipe which is not heat treated.

Representing here the stress generated during running of the plant by $\sigma_t$, so that the following relationship is established.

$$\sigma_t/\sigma_{t2}(D_1A_1) > \sigma_t/B_1C_1$$

That is, the ratio of the yielding stress to the actual stress is much increased, to improve the practical strength of the pipe.

Therefore, the pipe is rendered highly withstandable against repeated stress, even when it suffers from a corrosive fatigue due to a corrosive fluid passing therethrough, if the pipe has been treated in the manner stated above.

Thus, the strength of the pipe against corrosion fatigue is increased, even when a corrosive fluid is passed through the pipe, to well compare the strength of the pipe through which non-corrosive fluid is passed.

In other words, as stated above, the practical strength of the pipe is much improved.

The stress-strain curve of FIG. 4 has been drawn without taking the residual stress into consideration. However, this basic idea can be equally applicable to the case where there is a residual tensile stress in the inside of the pipe. Namely, in such a case, the stress derived from the temperature distribution is merely superimposed to the residual stress.

Thus, when there is an initial residual stress is left in the pipe, the temperature differential between the inner and the outer sides of the pipe may be smaller for obtaining a yield at the inside of the pipe, as compared with the case where there is no initial residual stress.

Similarly, when there is a residual compressive stress in the inside of the pipe 1, the residual compressive stress is further increased to enhance the strength of the pipe 1.

Since the heating relies upon an electric current passing through the pipe wall, the length of the pipe subjected to heating can optionally and easily be changed by suitably adjusting the positions of the electrodes and/or the current through the pipe wall. At the same time, since the heating can be performed by simply placing the electrodes on the pipe through which the cooling water is passed, the heat treating method of the invention can be applied even to complicated pipings.

The pipe can be heated by other methods than the direct electric heating stated above.

Hereinafter, an apparatus suitable for carrying out the method will be described with reference to FIG. 5.

A high-frequency-wave heating device 12, which is a kind of induction heating apparatus, is secured to a pipe 11 made of type 304 stainless steel 12BSch100.

The high-frequency-wave heating device 12 consists mainly of a heating coil 13 and a high-frequency oscillator 14 to which both ends of the heating coil 13 are connected.

Figure 6:
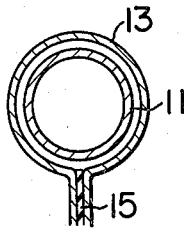
FIG. 6 is a sectional view taken along the line VI—VI of FIG. 5.

Between the both ends of the heating coil 13, there is disposed a heat-insulating material 15 as shown in FIG. 6. Although not fully shown, the heating coil 13 adapted to be fitted around the pipe 11 is of split type, for easier attaching.

Figure 7:
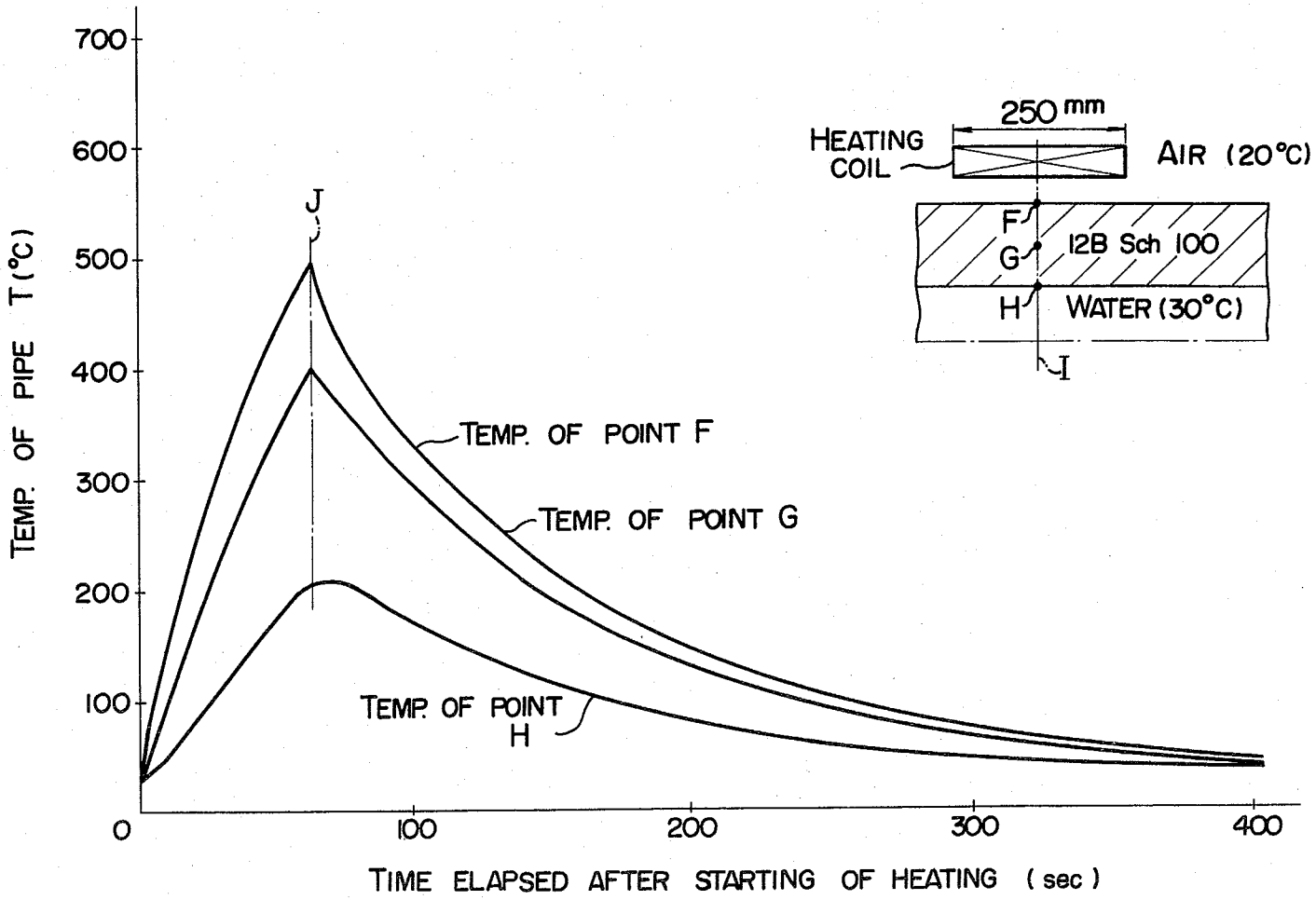
FIG. 7 shows a relationship between the time elapsed after commencement of heating and the temperature of a pipe treated by the heat treating method of FIG. 5.

Cooling water 16 of 30° C. is passed through the pipe 11, at a velocity of 0.43 m/sec. As the high frequency oscillator 14 is started, the heating coil 13 transmits a high frequency wave of 3.0 KHz, so as to induce a heating current in the pipe wall. The temperatures at the outer side, thickness wise bisector point and the inner side point F, G and H, within the axial bisector plane I of the heating coil 13 exhibit changes as shown in FIG. 7.

The oscillator 14 is stopped at an instant J, 62 seconds after the commencement of the heating. The temperatures at the points F, G and H come down accordingly. The temperature of the points F, G and H are about 500° C., 400° C. and 210° C., at that instant J.

The total heat generated in the pipe 11 by the high-frequency heating device amounts to about 158 Kw, and the axial length of the heating coil is 250 mm. The outer side of the pipe 11 is in contact with air of about 20° C. which constitutes the treating atmosphere.

Figure 8:
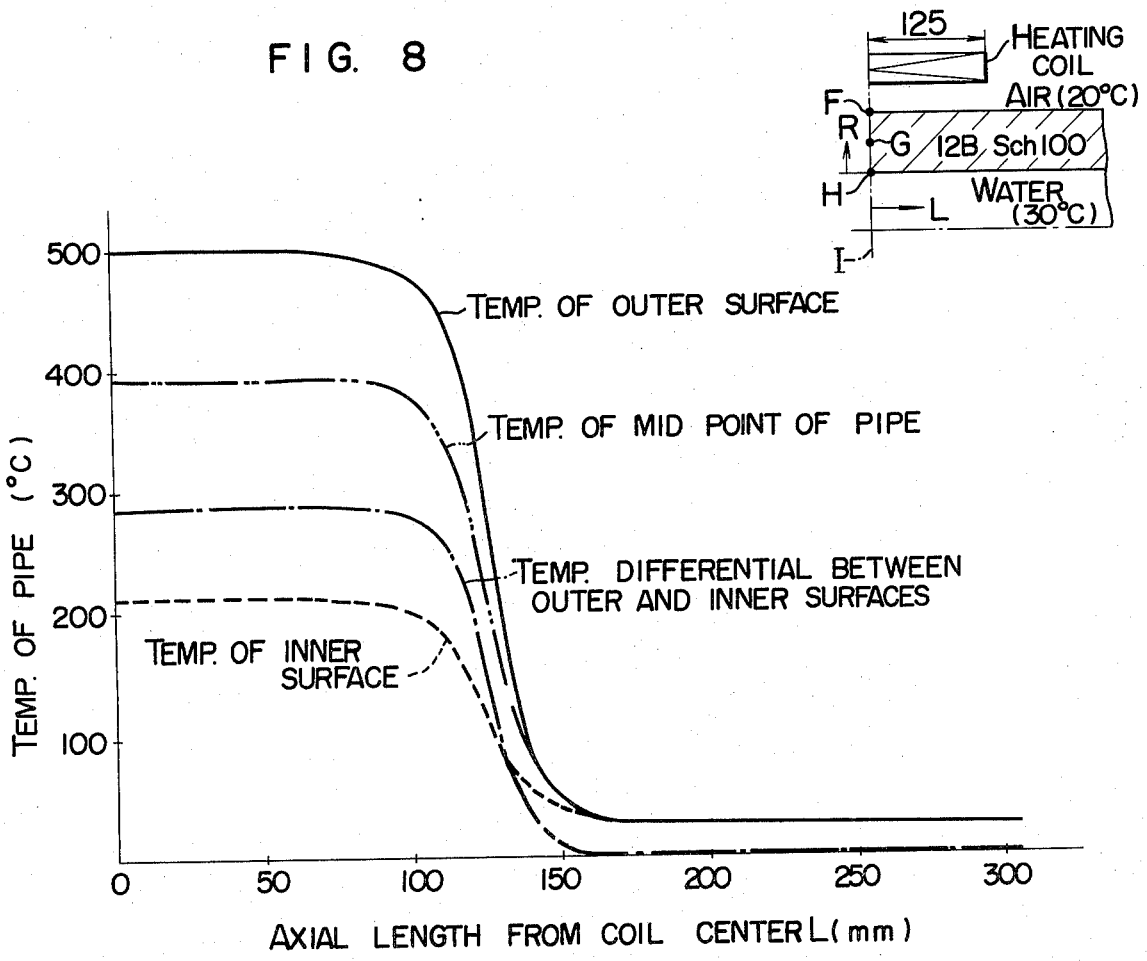
FIG. 8 shows a temperature variation of a pipe in the axial direction thereof, from the axial bisector point of a heating coil, at an instant J of FIG. 7.
Figure 9:
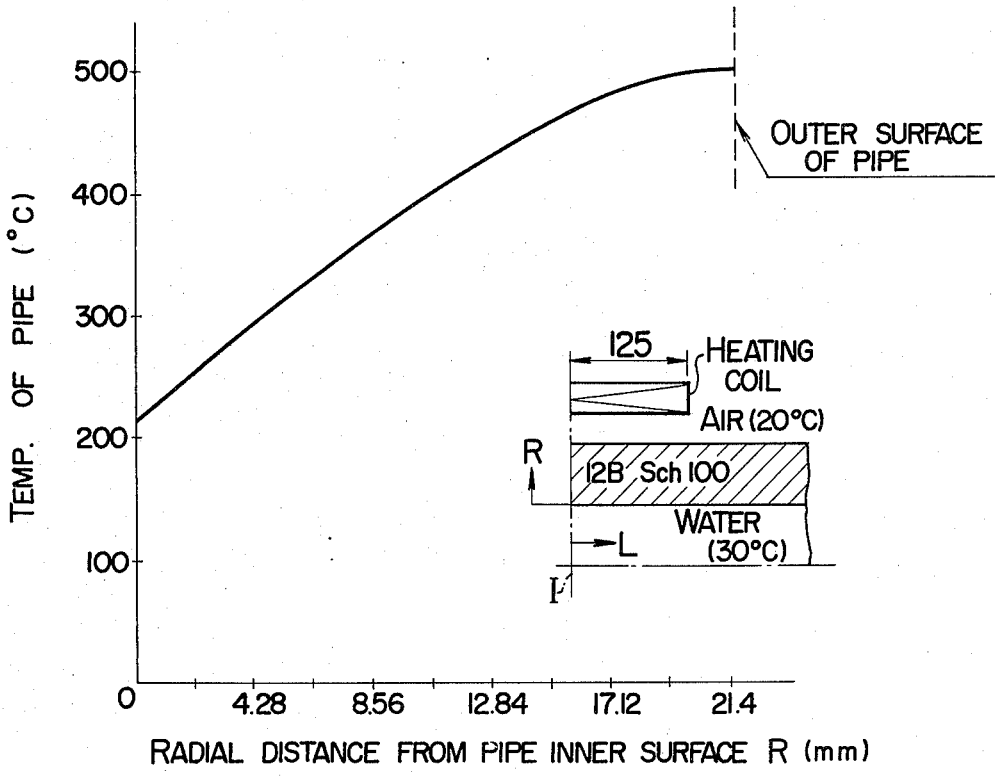
FIG. 9 shows a radial temperature distribution of the pipe at axial bisector point of a heating coil, at an instant J of FIG. 7.

FIG. 8 shows the axial temperature distribution around the axial bisector I of the heating coil, of the outer side, thickness wise bisector and the inner side of the pipe, at the instant J. It will be seen that the portion of the pipe surrounded by the heating coil 13 is specifically heated. FIG. 9 shows the temperature distribution in radial direction of the pipe 11 at the mid point I of the heating coil 13.

Figure 10:
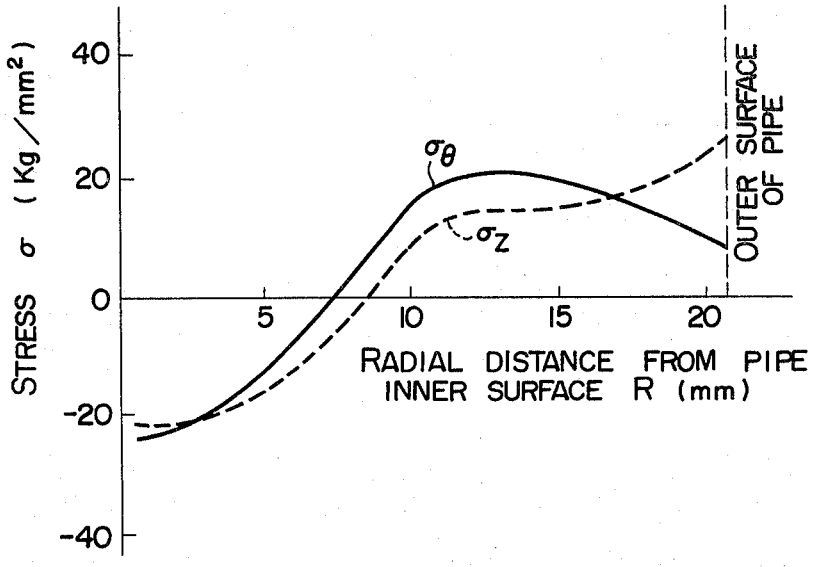
FIG. 10 shows a radial stress distribution of a pipe after having been treated by the heat treating method of FIG. 5, under room temperature.

FIG. 10 shows a radial distribution of stress in the pipe 11 cooled to the room temperature after having been treated by the method of the invention. In FIG. 10 $\sigma_Q$ and $\sigma_Z$ represent circumferential and axial stresses, respectively.

As the wall temperature of the pipe 11 comes down to the room temperature, the supply of the cooling water is stopped.

Figure 5:
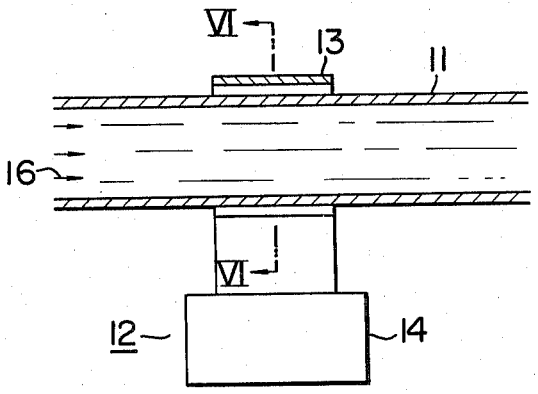
FIG. 5 is an illustration of a heat treating method for pipes, which is a preferred embodiment of the invention.

It will be seen that a compressive residual stress is generated in the inner side of the pipe 11, when the pipe 11 is treated by the apparatus of FIG. 5, so as to increase the ratio of the yielding stress to the actual stress during running of plant, so that the practical strength of the pipe is much increased, greatly contributing to avoid the pipe rupture.

Thus, the strength against the corrosion fatigue is much increased, so that the pipe is rendered withstandable to the corrosive fluid passing therethrough.

The effect of prevention of stress corrosion cracking is remarkable, especially when the invention is applied for the treatment of the described Austenite stainless steel. Namely, a residual compressive stress is generated at the inside of the Austenite stainless steel, so as to effectively prevent the stress corrosion fatigue cracking.

If necessary, the high-frequency heating device 12 is displaced along the pipe 11, maintaining the cooling water flow through the pipe, so as to generate the residual compressive stress at the inside of the pipe, over whole length of the latter.

The generation of the residual compressive stress at the inner side of the pipe is possible, not only for the described type 304 stainless steel, but also other materials such as low alloy steel including chrome-molybdenum steel, high alloy steel including nickel-chrome heat-resistant steel, carbon steel or copper, so as to improve the strength of pipes made of these materials against corrosion fatigue.

The cooling fluid need not always be water, but air, liquefied nitrogen and the like may be used as the cooling medium which passes through the pipe. This treating method is applicable to welded pipes. In such a case a specifically remarkable effect will be attained at the welded parts of the pipes.

It will be seen that the method of the invention basically relies upon a temperature differential between the outer and the inner sides of the pipe, large enough to cause a stress exceeding the compression yielding stress at the outer side of the pipe. Therefore, the cooling medium need not always be circulated, but may stay within the pipe during the external heating. However, such a measure cannot be applied to a treatment of thin-walled pipe, because it is extremely difficult to obtain a sufficiently large temperature differential between the outer and the inner sides of the pipe. Thus, the treating with non-circulated internal fluid is effective only to those pipes made of material having poor heat conductivity or pipes having larger wall thickness, as compared with the case of the circulated cooling medium.

Figure 11:
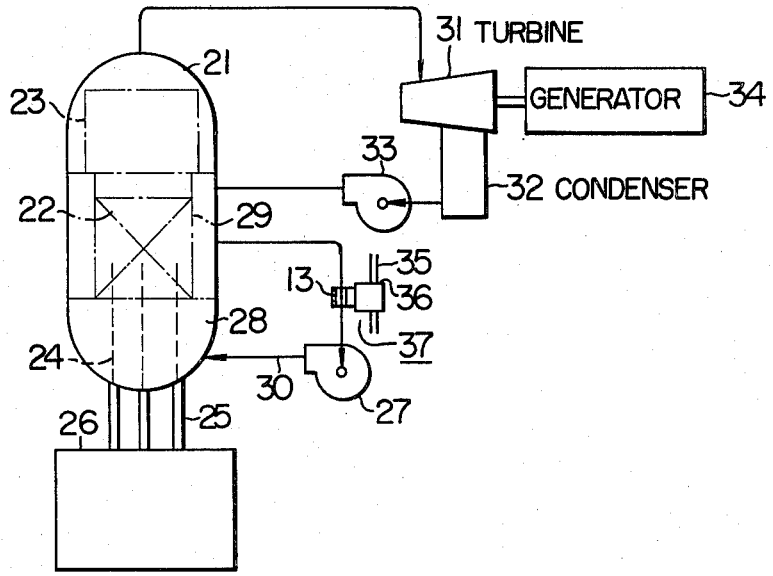
FIG. 11 illustrates a recirculation system piping of a boiling water reactor, in which the piping has been treated by the method as shown in FIG. 5.

The embodiment of FIG. 5 can fairly be applied to pipings installed in nuclear plants, power plants or chemical plants. An example will be described for the application of the method of the invention to a nuclear plant, with specific reference to FIG. 11. FIG. 11 shows a diagram of a nuclear power system employing a boiling water reactor.

A container 21 of the reactor houses a reactor core 22 loaded with nuclear fuel, a steam separating dryer 23 and a core shroud 29 surrounding the reactor core 22. A plurality of control rods 24 are inserted into the reactor core 22. The control rods are moved up and down by a control rod driving apparatus 25, under a control by a controller 26.

The container 21 is filled to a certain high level with light water which is the coolant. The water is circulated to the reactor core 22, through a recirculating pipe 30 and then through a lower prenum, as a circulating pump 27 in the recirculating pipe 30 is started.

The water is heated by the reactor core 22 as it passes through the latter, and is changed into steam as it gets upper portion of the reactor. After having passed through a separating dryer 23, the steam is fed to a turbine 31. The steam expanded through the turbine 31 is finally condensed in a condenser 32. The turbine 31 drives a generator 34 connected thereto. The condensate at the condenser 32 is then fed back to the inside of the reactor container 21.

A guide rail 35 is laid along the recirculating pipe 30. A high-frequency oscillator 36 is provided, so as to saddle over the guide rail 35. A heating coil 13 is connected at its both ends to the oscillator 36. Between the ends of the heating coil 13, disposed is an electrically insulating material, as shown in FIG. 6.

The heating coil 13 and the high-frequency oscillator 36 in combination constitutes a high-frequency-wave heating device 37. Although not shown in the drawings, the oscillator 36 carries a driving motor having a pinion engaging a rach provided on or along the rail 35.

For heat-treating the pipe 30, the circulating pump 27 is started to circulate the water through the pipe 30. Then, the oscillator 36 is started to enable the heating coil 13 to heat the pipe 30, during which the driving motor (not shown) is energized so as to gradually move the high-frequency-wave heating device 37 along the rail 35 and, accordingly, along the pipe 30. Consequently, the portion of the pipe under influence of the heating device is gradually shifted, so that almost all part of the pipe 30 including welded portions can be heat-treated.

The speed of movement of the heating coil 13 is so adjusted that the outer surface temperature of the pipe under heating exceeds a temperature which would cause a stress in the outer side of the pipe exceeding the compression yielding stress.

The circulating pump 27 is stopped when the treatment is finished for the entire length of the pipe.

Consequently, a compressive residual stress is generated at the inside of the pipe 30, as is the case of the foregoing embodiment. Therefore, the corrosion fatigue strength of the pipe 30 is much increased, so that the pipe rupture is avoided even when the coolant is circulated through the pipe 30 with a severe condition. The effectiveness of prevention of stress corrosion cracking is remarkable, because the pipe 30 is generally made of type 304 stainless steel.

It will be seen that the residual compression stress can be generated at the inside of pipes, even after the installation of these pipes in a plant. In addition, the heat-treatment can be effected on any desired pipe in a plant, by arranging the guide rail along the objective pipe.

In the foregoing embodiments of the invention, a residual compression stress is created at the inside of the pipe. However, to the contrary, the invention may be carried out in such a way that a residual compression stress is generated at the outer side of a pipe, by obtaining a negative temperature differential, through heating the inside of the pipe while cooling the outer side of the pipe. This can be performed by heating the interior of the pipe while passing a cooling fluid such as water along and in contact with the outer face of the pipe. This way of heat treatment is especially suitable for treating those pipes which are contacted by corrosive liquid at outside, e.g. pipes which are installed in the sea.

Thus, according to the invention, a residual compression stress is produced in the side of a pipe contacted by a corrosive liquid, so that the pipe is protected against the rupture.

What is claimed is:

1. A method of heat-treating piping in situ within a plant comprising the steps of:

(a) supplying a liquid coolant to the piping after said piping is installed by plastic working or welding of portions of the piping in a plant, said plastic working or welding causing residual stresses that may lead to stress corrosion;

(b) heating the outer side of the plastic worked or welded portions of said piping while the liquid coolant is present in said piping to create a great temperature differential between said outer side of said piping and the inner side of said piping so that compressive yielding is produced in said outer side of said piping and tensile yielding is produced in said inner side of said piping; and then (c) stopping the heating of said piping whereby residual compressive stress is induced into said portions to reduce possible stress corrosion during subsequent operation of said plant.

2. A method of heat-treating piping in situ within a nuclear power plant comprising the steps of:

(a) supplying a liquid coolant to the piping after the piping is installed by plastic working or welding of portions of the piping in the plant, said working or welding causing residual stresses that may lead to stress corrosion of said piping;

(b) heating the outer side of the plastic work or welded portions of said piping while said coolant is present in said piping to create a great temperature differential between said outer side of said piping and the inner side of said piping so that compressive yielding is produced in said outer side of said piping and tensile yielding is produced in said inner side of said piping; and then (c) stopping the heating of said piping whereby a residual compressive stress is induced into said portions to reduce possible stress corrosion during operation of said nuclear power plant.

3. A method of heat-treating piping as claimed in claim 1, wherein said liquid coolant is passed through said piping to cool the inside of said piping.

4. A method of heat-treating piping as claimed in claim 3, wherein heating of the outer side of the piping is effected by induction heating means.

5. A method of heat-treating piping as claimed in claim 4 wherein said outer side is heated with said induction heating means moved in the axial direction of said piping.

6. A method of heat-treating piping as claimed in claim 5, wherein said induction heating means are high-frequency-wave heating means.

7. A method of heat-treating piping as claimed in claim 6, wherein said pipe is made of Austenite stainless steel.

8. A method of heat-treating piping as claimed in claim 2, wherein said coolant is passed through said piping for cooling said inner side of said piping.

9. A method of heat-treating piping as claimed in claim 8, wherein said piping is connected at opposite ends thereof to a pressure vessel of a nuclear reactor of said nuclear power plant, and said coolant is supplied through one end of said piping from the pressure vessel to said piping and returned through the other end of the piping to the pressure vessel.

10. A method of heat-treating piping as claimed in claim 9, wherein heating of the outer side of said piping is effected by induction heating means.

11. A method of heat-treating piping as claimed in claim 10, wherein said outer side of the piping is heated while said induction heating means is moved axially of the piping.

12. A method of heat-treating piping as claimed in claim 6, wherein said outer side of the piping is made of Austenite stainless steel.

13. A method of heat-treating piping as claimed in claim 8, wherein said outer side of said piping heated by induction heating means.

14. A method of heat-treating piping as claimed in claim 13, wherein said heating means are high-frequency-wave heating means.

15. A method of heat-treating piping as claimed in claim 14, wherein said outer side of piping made of Austenite stainless steel.

16. A method of heat-treating piping as claimed in claim 13, wherein said induction heating means are adapted to be moved in the axial direction of said piping during the heating of said outer side of said piping.

17. A method of heat-treating piping as claimed in claim 10, wherein said induction heating means are high-frequency-wave heating means.

18. A method of heat-treating piping as claimed in claim 17, wherein said piping is made of Austenite stainless steel.

19. A method of heat-treating piping as claimed in claim 2, wherein said piping is made of Austenite stainless steel.

20. A method of heat-treating piping as claimed in claim 2, wherein said outer side of said piping is heated by induction heating means.

21. A method of heat-treating piping as claimed in claim 20, wherein said induction heating means are high-frequency-wave heating means.

22. A method of heat-treating piping as claimed in claim 20, wherein said induction heating means are moved in the axial direction of said piping, while said outer side of said piping is heated.

23. A method of heat-treating piping as claimed in claim 21, wherein said piping is Austenite stainless steel.

24. A method of heat-treating piping as claimed in claim 1, wherein said outer side of said piping is heated with induction heating means that is moved in the axial direction of said piping.

25. A method of heat-treating piping as claimed in claim 1, wherein said induction heating means are high-frequency-wave heating means.

26. A method of heat-treating piping as claimed in claim 24, wherein said piping is made of Austenite stainless steel.

* * * * *